US009630235B2

(12) United States Patent
Takai et al.

(10) Patent No.: US 9,630,235 B2
(45) Date of Patent: Apr. 25, 2017

(54) ROLLER HEMMING PROCESSING DEVICE AND ROLLER HEMMING PROCESSING METHOD

(71) Applicant: Nissan Motor Co., Ltd., Kanagawa (JP)

(72) Inventors: Ryoji Takai, Kanagawa (JP); Kazuya Aoki, Kanagawa (JP)

(73) Assignee: NISSAN MOTOR CO., LTD., Kanagawa (JP)

( * ) Notice: Subject to any disclaimer, the term of this patent is extended or adjusted under 35 U.S.C. 154(b) by 0 days.

(21) Appl. No.: 14/786,839

(22) PCT Filed: Feb. 12, 2014

(86) PCT No.: PCT/JP2014/053118
§ 371 (c)(1),
(2) Date: Oct. 23, 2015

(87) PCT Pub. No.: WO2014/174874
PCT Pub. Date: Oct. 30, 2014

(65) Prior Publication Data

US 2016/0074924 A1 Mar. 17, 2016

(30) Foreign Application Priority Data

Apr. 24, 2013 (JP) ..... 2013-090970

(51) Int. Cl.
*B21D 39/02* (2006.01)
*B21D 19/04* (2006.01)
*B21D 43/26* (2006.01)

(52) U.S. Cl.
CPC ..... *B21D 39/023* (2013.01); *B21D 19/043* (2013.01); *B21D 43/26* (2013.01);
(Continued)

(58) Field of Classification Search
CPC ..... B21D 5/16; B21D 11/22; B21D 19/02; B21D 19/04; B21D 19/043; B21D 19/06;
(Continued)

(56) References Cited

U.S. PATENT DOCUMENTS

2012/0260711 A1 10/2012 Ikeda et al.

FOREIGN PATENT DOCUMENTS

JP H05-50161 A 3/1993
JP 2002-160031 A 6/2002
(Continued)

OTHER PUBLICATIONS

International Search Report issued in corresponding International Application No. PCT/JP2014/053118, mailed on Apr. 8, 2014 (1 page).
(Continued)

*Primary Examiner* — Peter DungBa Vo
*Assistant Examiner* — Joshua D Anderson
(74) *Attorney, Agent, or Firm* — Osha Liang LLP

(57) ABSTRACT

A roller hemming processing apparatus adapted to perform a hemming processing has a hemming die, on which a panel-like workpiece having a hemming flange portion on a periphery portion thereof, is positioned and supported, a roller hemming processing tool that is moved along a longitudinal direction of the hemming flange portion to bend the hemming flange portion at a root portion thereof while pressing the hemming flange portion toward the hemming die, and a nesting block disposed at a part of the periphery of the hemming die. The nesting block performs positioning of the workpiece by being brought into contact with the root portion of the hemming flange portion with which the workpiece is formed. The nesting block is elastically sup-
(Continued)

ported to be retractable in the pressing direction and to be swingably displaceable in the longitudinal direction of the hemming flange portion.

6 Claims, 11 Drawing Sheets

(52) U.S. Cl.
CPC .... *Y10T 29/53709* (2015.01); *Y10T 29/53791* (2015.01); *Y10T 29/53961* (2015.01); *Y10T 29/53996* (2015.01)

(58) Field of Classification Search
CPC ..... B21D 19/12; B21D 39/02; B21D 39/021; B21D 39/023; B21D 43/003; B21D 43/26
USPC ..... 72/214, 215, 220, 411, 461, 465.1, 466, 72/466.8, 466.7; 29/464, 466, 505, 509, 29/513, 514, 559, 243.5, 243.58, 281.1, 29/283.5
See application file for complete search history.

(56) References Cited

FOREIGN PATENT DOCUMENTS

| | | | |
|---|---|---|---|
| JP | 2008-093689 | A | 4/2008 |
| WO | 2012/039320 | A1 | 3/2012 |

OTHER PUBLICATIONS

International Preliminary Report on Patentability issued in corresponding International Application No. PCT/JP2014/053118, mailed on Oct. 27, 2015 (8 pages).

(A)

(B)

1···HEMMING DIE
2a···DIE FACE
6···NESTING MECHANISM
7···HOLDER
8···NESTING BLOCK
8b···NESTING CLAW SECTION
15···RECESS PART (A)

(B)

ROLLER HEMMING PROCESSING DEVICE AND ROLLER HEMMING PROCESSING METHOD

BACKGROUND

Technical Field

The present invention relates to a roller hemming processing apparatus and a roller hemming processing method, to conduct a hemming coupling on a panel-like workpiece.

Related Art

This type of roller hemming processing system has been proposed by the present applicant, as discussed in Patent Document 1. The roller hemming processing system as discussed in Patent Document 1 is adapted so as to provide a plurality of claw portions around a hemming die. At the time of loading a panel-like workpiece (previously formed with a hemming flange portion) on the hemming die, these claw portions contribute to the positioning of the workpiece. Then a roller hemming processing tool (for example, held by a robot arm) is moved along the longitudinal direction of the hemming flange portion while being pressed against the hemming flange portion, thereby achieving a preliminary bending (a pre-hemming processing) or a main bending (a main-hemming processing).

In such a roller hemming processing, the claw portions that govern the positioning of the workpiece sometimes interfere with the hemming processing tool in accordance with a shape of the hemming processing tool and the like. Depending on the extent of the interference, there may arise a fear that a hemming process quality is adversely affected. In the roller hemming processing system as discussed in Patent Document 1, therefore, it is necessary to move the hemming processing tool along such a locus as not to interfere with the claw portions around portions of the hemming flange portion corresponding to the positioning claw portions. However, the thus controlled locus of the hemming processing tool becomes complicated. In addition, it is also necessary to reduce the moving speed in the vicinity of the portions in question, which is not preferable because the productivity should inevitably be lowered.

PATENT DOCUMENTS

Patent Document 1: International Publication No. 2012/039320

SUMMARY

An interference between a means for positioning a workpiece and a hemming processing tool may occur in a roller hemming processing. One or more embodiments of the present invention positions the workpiece as a movable one, thereby providing a roller hemming processing apparatus and roller hemming processing method so allowed that the interference between the hemming processing tool and the positioning means does not adversely affect a hemming process quality.

In one or more embodiments of the present invention, a nesting block is provided at a part of the periphery of the hemming die, the nesting block governing the positioning of the workpiece by being brought into contact with the root portion of the hemming flange portion with which the workpiece is formed. The nesting block is elastically supported to be retractable in the pressing direction and to be swingably displaceable in the longitudinal direction of the hemming flange portion.

With this arrangement, it is possible to retract the nesting block by the pressing force of the hemming processing tool up to a location not adversely affecting the hemming processing quality since the nesting block keeps its flexibility in the retracting direction and the swingably displaceable direction even if the hemming processing tool and the nesting block are interfered with each other at the time of hemming processing. Accordingly, the hemming processing can be accomplished as needed without paying particular attention to the presence of the nesting block, only by moving the hemming processing tool along the longitudinal direction of the hemming flange portion.

According to one or more embodiments of the present invention, a nesting block elastically supported to be retractable in the pressing direction and to be swingably displaceable in the longitudinal direction of the hemming flange portion is adopted. This makes it possible to retract the nesting block up to a location not adversely affecting the hemming processing quality even if the hemming processing tool comes to interfere with the nesting block, with which the hemming processing quality is improved.

In addition, the hemming processing can be accomplished as needed without paying particular attention to the presence of the nesting block, only by moving the hemming processing tool along the longitudinal direction of the hemming flange portion. Controlling of the movement locus of the movement of the hemming processing tool is simplified thereby, without reducing the moving speed of the hemming processing tool. Thus, the improvement in productivity can also be expected.

DETAILED DESCRIPTION

Embodiments of the present invention will be described below with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. Referring now to FIGS. 1(A) to 12, a roller hemming processing apparatus according to one or more embodiments of the present invention will be explained. In this case, there is shown an example in which one or more embodiments of the present invention is applied to the hemming processing for a door panel (e.g., a front door panel or a rear door panel) of an automotive vehicle which is constructed by hemming coupling between panel-like workpieces (a door outer panel and a door inner panel).

The roller hemming processing of the door panel includes both a pre-hemming processing (preliminary bending) and a main-hemming processing (main bending). In the pre-hemming processing (preliminary bending), a hemming flange portion F previously formed by bending in an uplight or upstanding posture around a periphery of a door outer panel (hereinafter referred to as merely an outer panel) Wa which will be connected with a door inner panel (hereinafter referred to as merely an inner panel) Wb by hemming coupling as shown in FIG. 1(A), disposed at the side of the outer panel Wa is bent substantially 45 degrees toward the inner panel Wb as shown in FIG. 1(B) and FIG. 2(A) upon relatively positioning a hemming die 1 (as a die for hemming processing) and the outer panel Wa and the inner panel Wb, by using a pre-hemming roller 5A (a roller hemming processing tool). In the main-hemming processing, the hemming flange portion F after being subjected to the pre-hemming processing is further bent to be superimposed on an end portion of the inner panel Wb by using a main-hemming roller 5B (another roller hemming processing tool) as shown in FIG. 1(C) and FIG. 2(B) so that the end portion of the inner panel Wb is interposed between a main portion of the outer panel Wa and the hemming flange portion F, thereby forming the hemming coupling. Incidentally, the inner panel Wb is omitted from FIGS. 2(A)-2(B).

Figure 1:
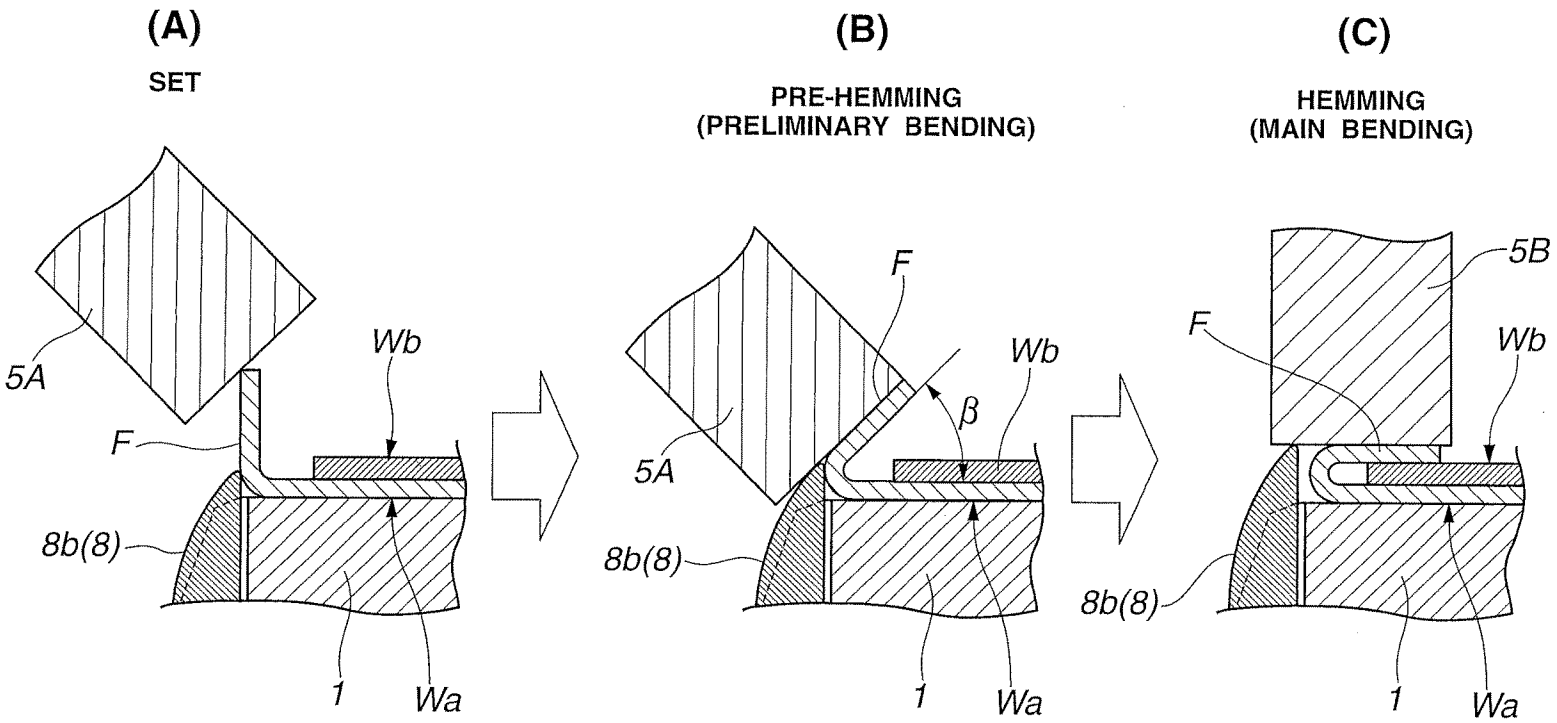
FIGS. 1(A), 1(B), and 1(C) show cross-sectional views of a main part of a roller hemming processing apparatus according to one or more embodiments of the present invention, explaining the progress of processing including a panel-loading, a pre-hemming (or preliminary bending) processing and a hemming (or main bending) processing.
Figure 2:
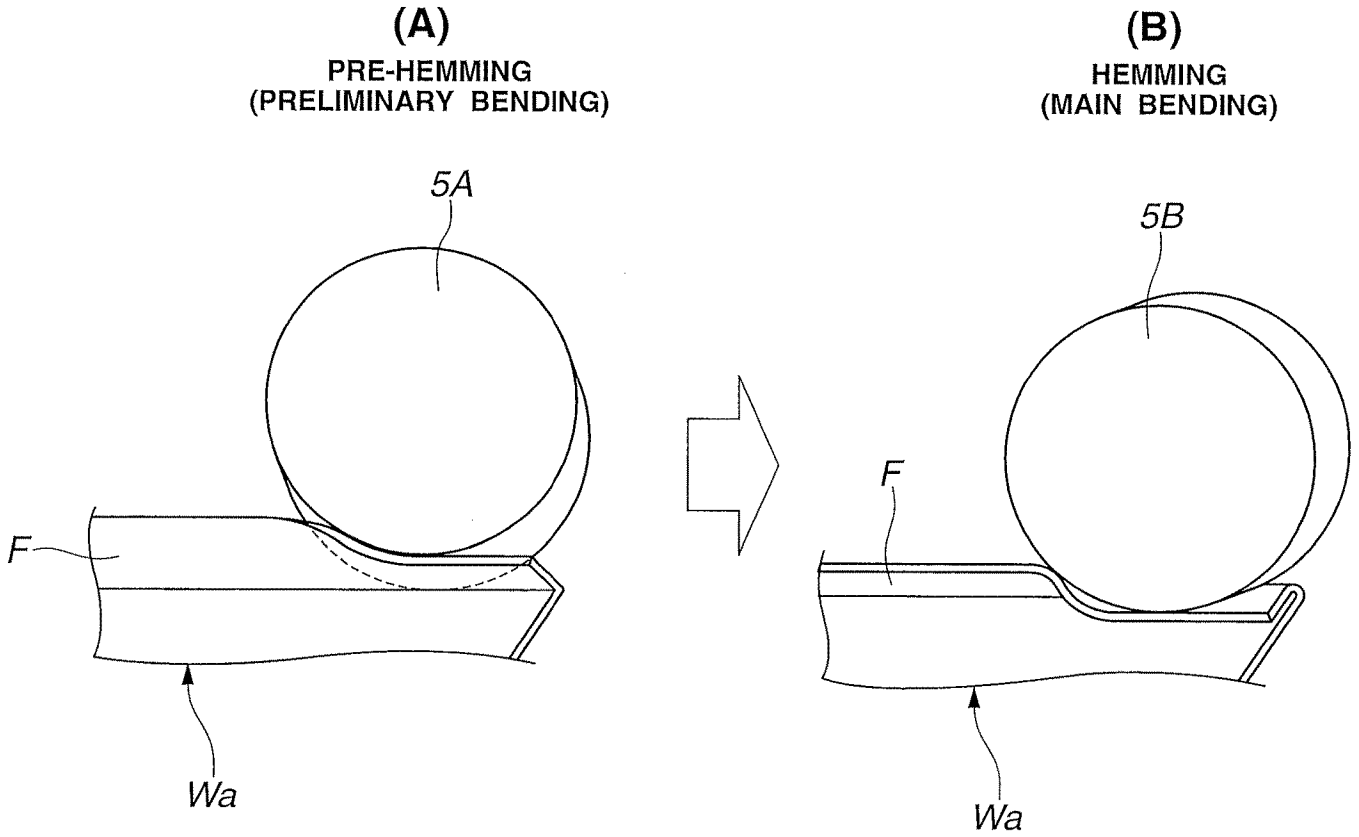
FIGS. 2(A) and 2(B) show perspective views of the main part, showing the details of the pre-hemming (or preliminary bending) processing and the hemming (or main bending) processing as shown in FIGS. 1(A)-1(C).
Figure 3:
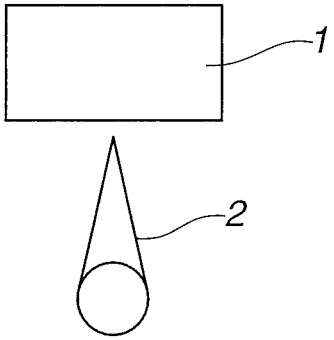
FIG. 3 is an explanatory view showing the outline of a hemming processing stage that governs the hemming processing in the roller hemming processing apparatus according to one or more embodiments of the present invention.
Figure 4:
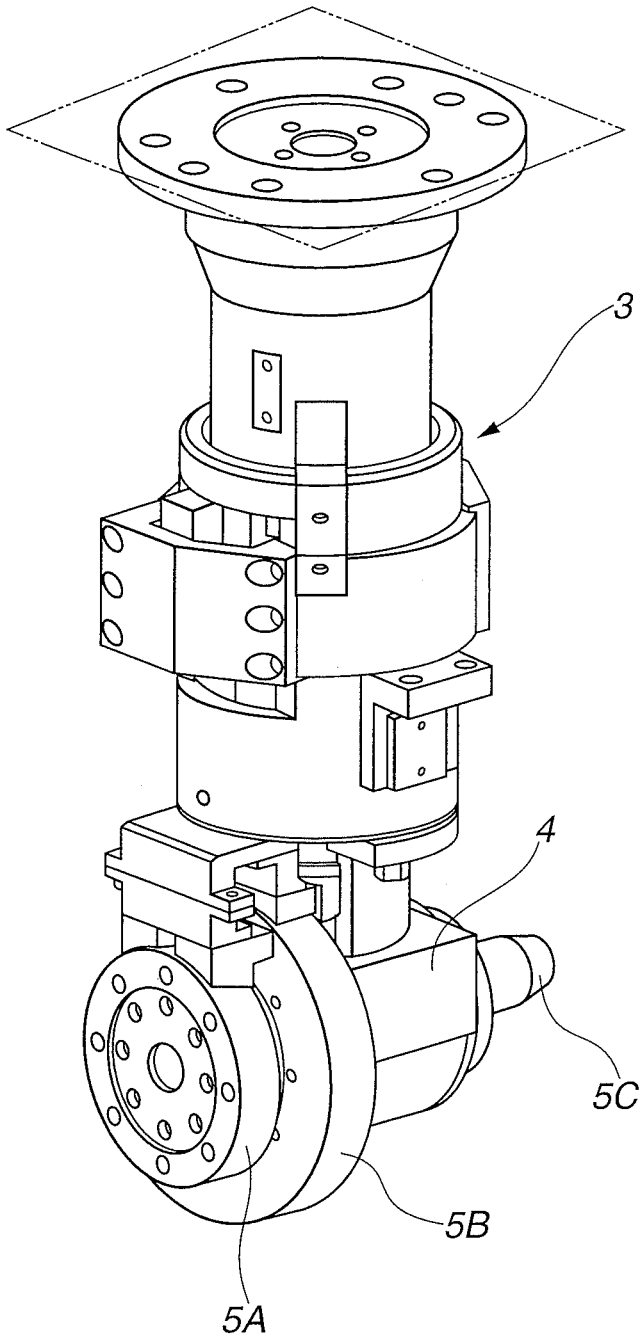
FIG. 4 shows a perspective view of a tool unit for the roller hemming processing, the tool unit being supported by the robot of FIG. 3.
Figure 5:
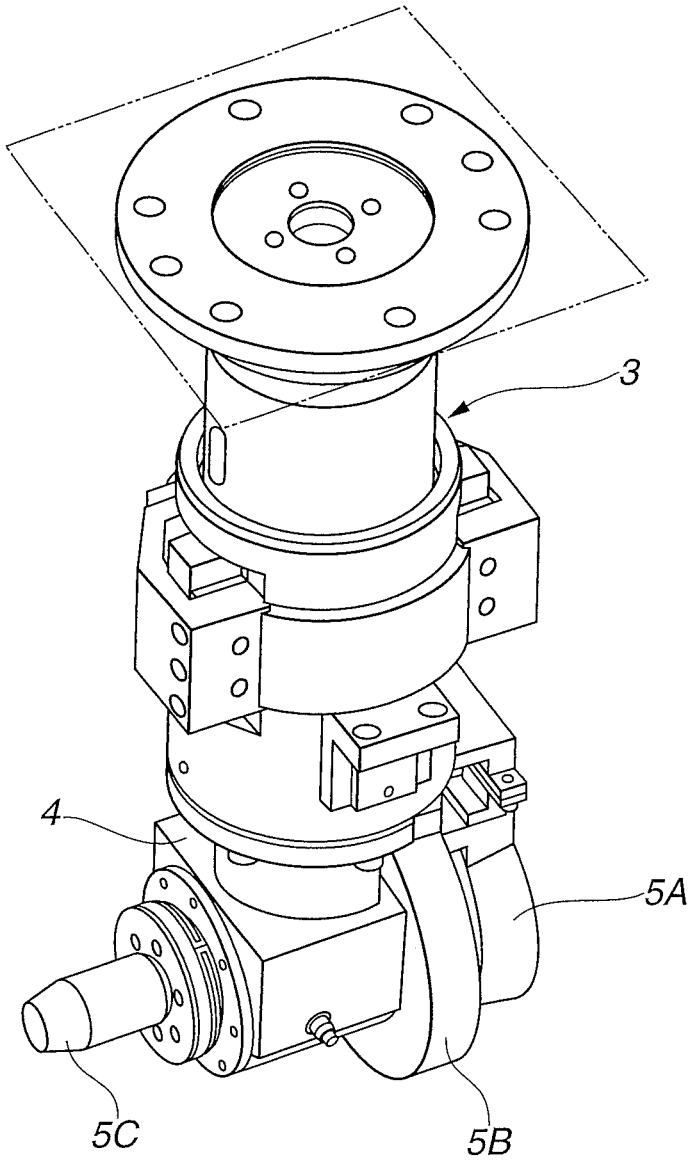
FIG. 5 shows a perspective view of the tool unit as shown in FIG. 4 but taken from another direction.
Figure 6:
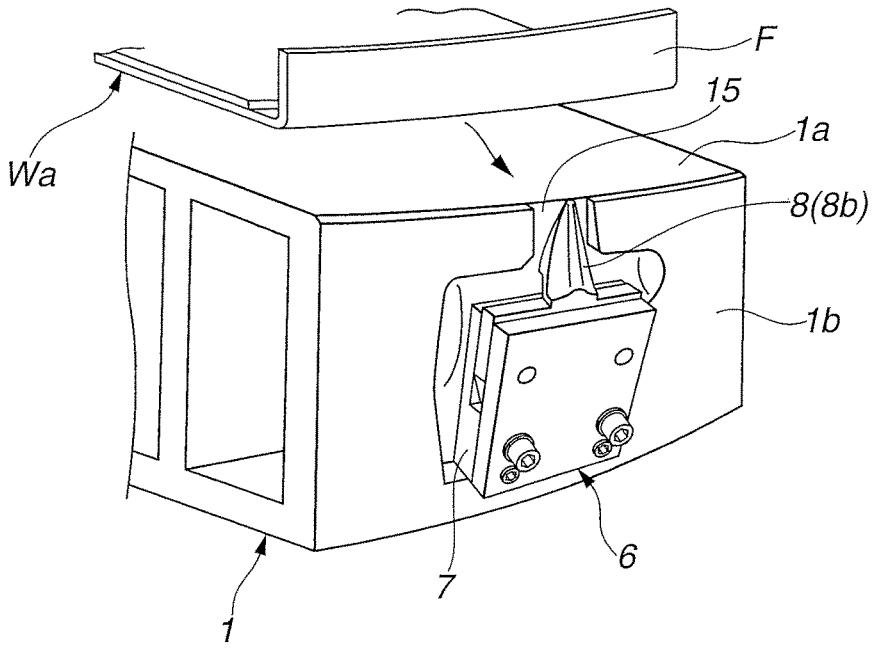
FIG. 6(A) shows a perspective view of a main part of a hemming die as shown in FIG. 3.
FIG. 6(B) shows a view similar to FIG. 6(A) but explaining the occasion of the pre-hemming (or preliminary bending) processing on the hemming die.
Figure 6:
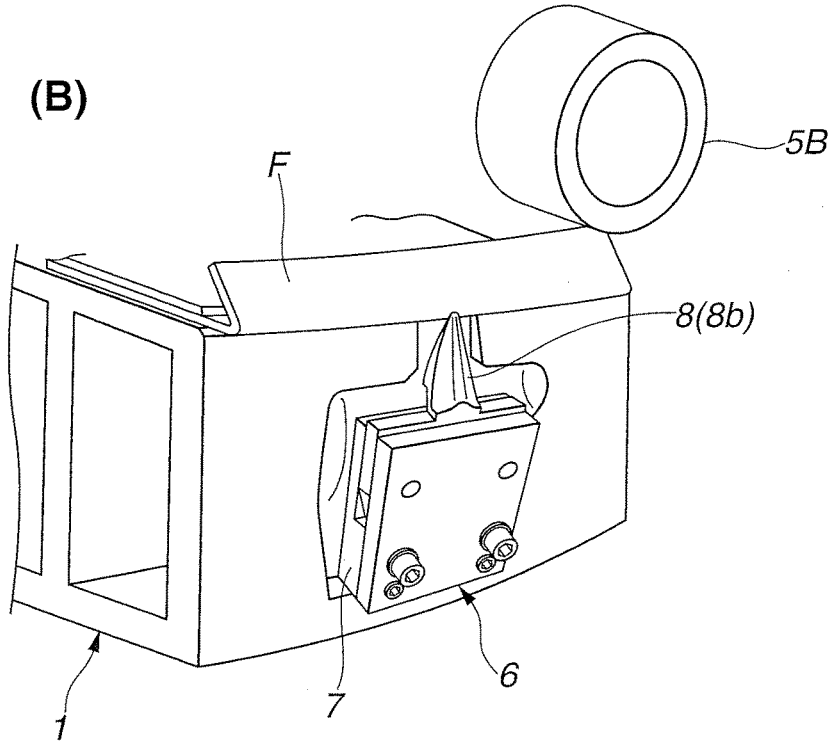

As shown in FIG. 3, a hemming processing robot 2 (hereinafter referred to as merely a robot) serving as an industrial robot is disposed in the vicinity of the hemming die 1. The robot 2 has a robot arm which supports at its tip end a tool unit 3 as shown in FIGS. 4 and 5. At a holder 4 of the tool unit 3, there are provided three kinds of rotatable hemming rollers 5A to 5C each of which serves as the above-mentioned roller hemming processing tool, which have different diameters and arranged coaxially with each other. The hemming processing including pre-hemming, as shown in FIGS. 1(A)-1(C) and 2(A)-2(B) is performed by selectively using these three kinds of the hemming rollers 5A to 5C. Besides, these hemming rollers 5A, 5B, and 5C correspond to the hemming roller R of FIGS. 2(A)-2(B).

The hemming roller 5B having a diameter largest among those of the three kinds of hemming rollers 5A to 5C as shown in FIGS. 4 and 5 is used mainly for hemming processing (main bending), and the outer peripheral surface of the hemming roller 5B is shaped into a cylindrical surface. Meanwhile, the hemming roller 5A having a medium diameter is used mainly for preliminary bending processing (main bending), and the outer peripheral surface of the hemming roller 5A is shaped like a conical surface. Additionally, the hemming roller 5C having the smallest diameter is used for preliminary bending processing and main bending at a section having an extremely small radius of curvature (for example, a corner section of a door panel), and the outer peripheral surface of the hemming roller 5C is formed to include both a cylindrical surface and a conical surface.

FIGS. 6(A)-6(B) are perspective views of a main part of the hemming die 1 as shown in FIG. 3. As conventionally known, the outer panel Wa serving as a work object is loaded onto a die face 1*a* of the hemming die 1, under the state of being combined with the inner panel Wb. FIG. 6(B) shows view similar to FIG. 6(A) but explaining the occasion of the pre-hemming (or preliminary bending) processing on the hemming die. At a part of the periphery of the hemming die 1, a nesting mechanism 6 that governs the positioning of the outer panel Wa having been loaded onto the hemming die 1 is provided. Though at least two nesting mechanisms 6 are to be disposed within one side portion of the outer panel Wa with a certain interval, only one nesting mechanism 6 is illustrated in FIGS. 6(A)-6(B).

The nesting mechanism 6 is constructed such that a generally rectangular holder 7 (as a supporting member) is secured to a side wall 1*b* of the hemming die 1 with a bolt and a movable nesting block 8 is supported by the holder 7.

Figure 7:
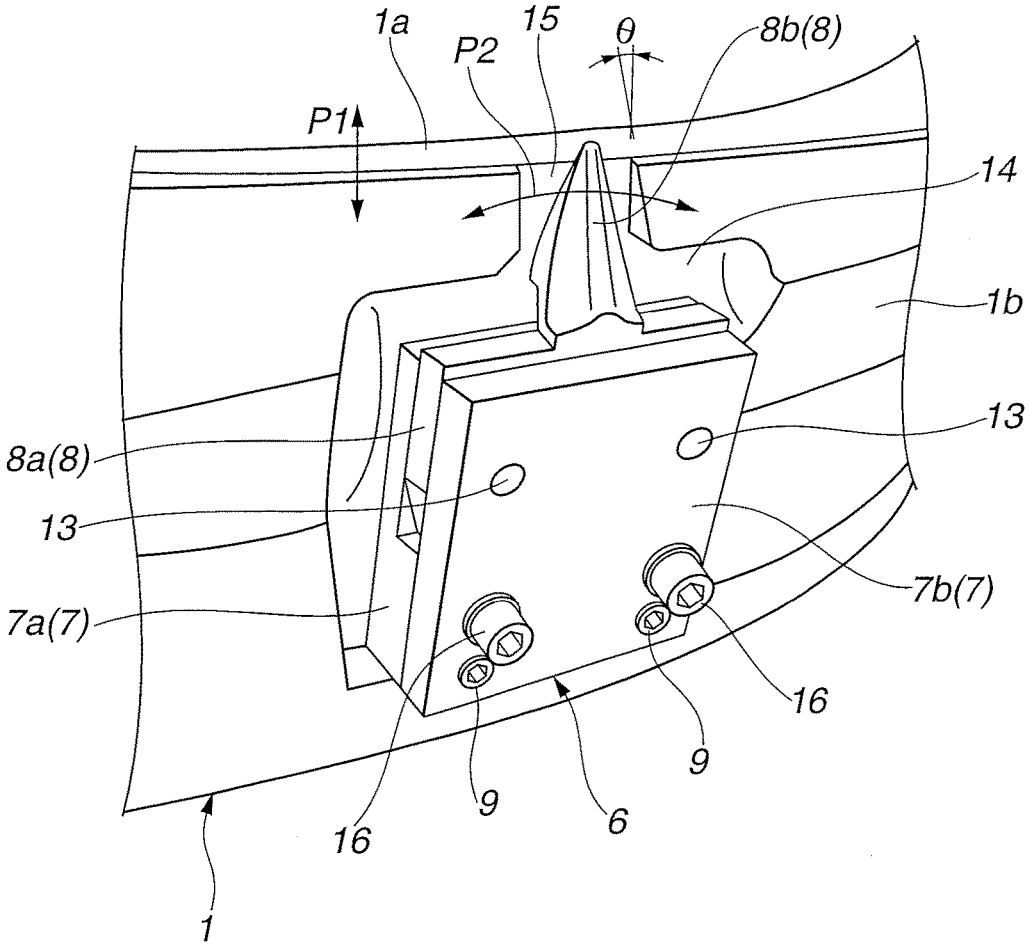
FIG. 7 shows a further enlarged view of the main part of the hemming die as shown in FIGS. 6(A)-6(B).
Figure 8:
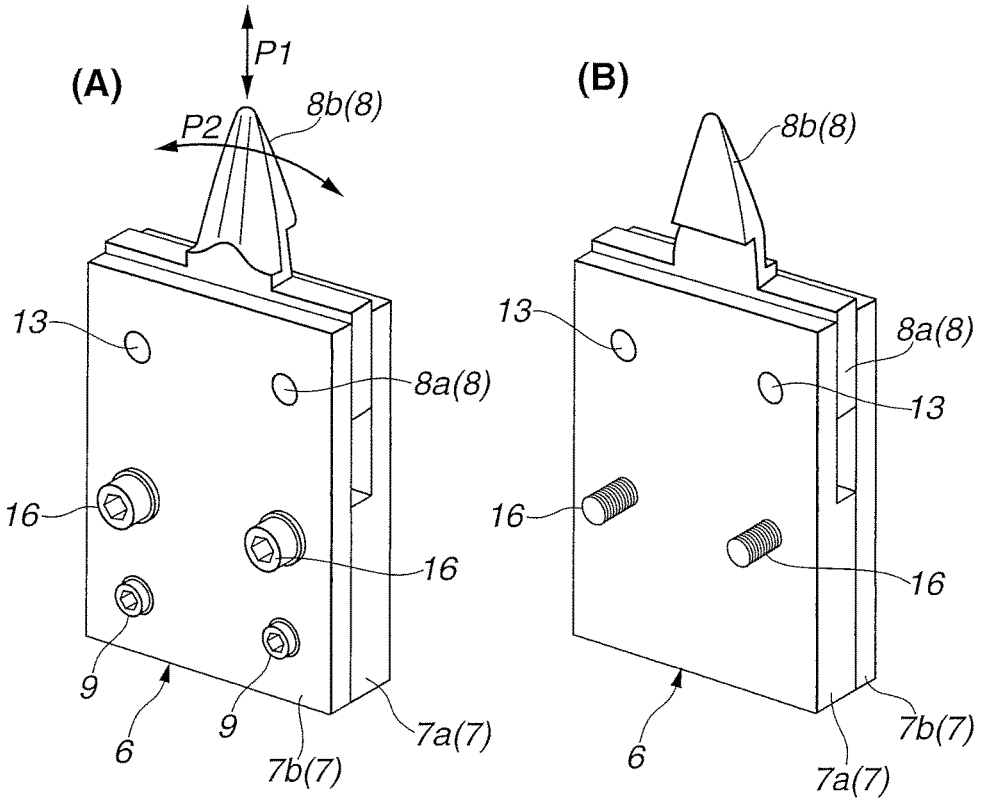
FIG. 8(A) shows a perspective view of a nesting mechanism alone.
FIG. 8(B) shows a perspective view similar to FIG. 8(A) but taken from the opposite side.

FIG. 7 is a further enlarged view of the main part as shown in FIG. 6(A). Each of FIGS. 8(A)-8(B) and 9(A)-9(B) shows the detail of the nesting mechanism 6 as shown in FIG. 7 but separated therefrom by itself. As is evident from FIGS. 7 to 9(B), the holder 7 is provided to include a back plate 7*a* having a rectangular stepwise shape, and a front cover 7*b* having a shape generally similar to that of the back plate 7*a*. The back plate 7*a* and the front cover 7*b* are fastened to each other with bolts 9 thereby supporting the movable nesting block 8 therebetween. Moreover, the holder 7 of the nesting mechanism 6 is firmly fixed by bolts 16 to adopt a certain tilting posture with respect to the after-mentioned concave part 14 of the hemming die 1.

As shown in FIGS. 8(A) and 9(B), the nesting block 8 is provided to include: a flat wide mounting base section 8*a*; and a nesting claw section 8*b* integrally projected therefrom and shaped tapered upwardly. The mounting base section 8*a* is formed with a pair of elongated holes 10 parallel with each other. Furthermore, the nesting block 8 is upwardly biased by compression coil springs 12 (a pair of elastic members) interposed between the nesting block 8 and the step portion 11 on the side of the back plate 7*a*. Meanwhile, a pair of pins 13 are driven astride the back plate 7*a* and the front cover 7*b* constituting the holder 7, so as to pierce through the elongated holes 10 formed on the side of the nesting block 8.

Figure 9:
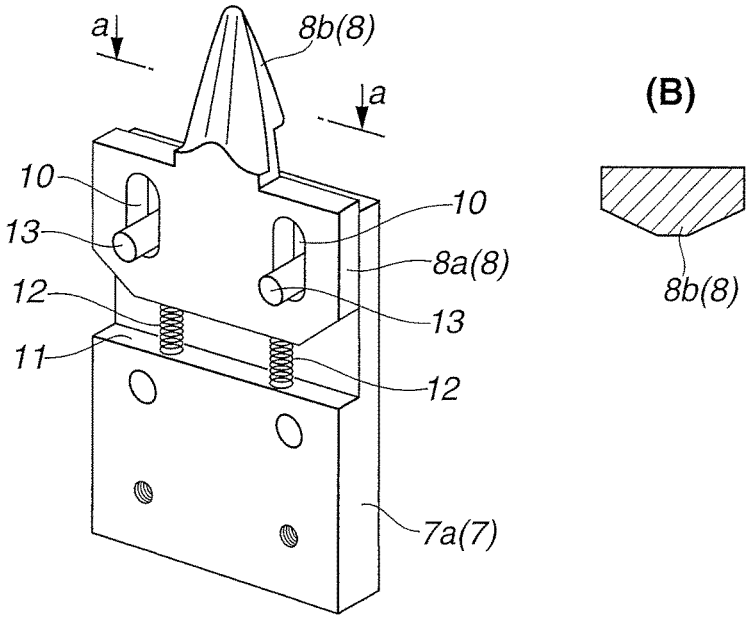
FIG. 9(A) shows a perspective view of the nesting mechanism as shown in FIGS. 8(A)-8(B) but showing a state where a front cover has been removed therefrom.
FIG. 9(B) shows a cross-sectional view taken along the line a-a of FIG. 9(A).
Figure 10:
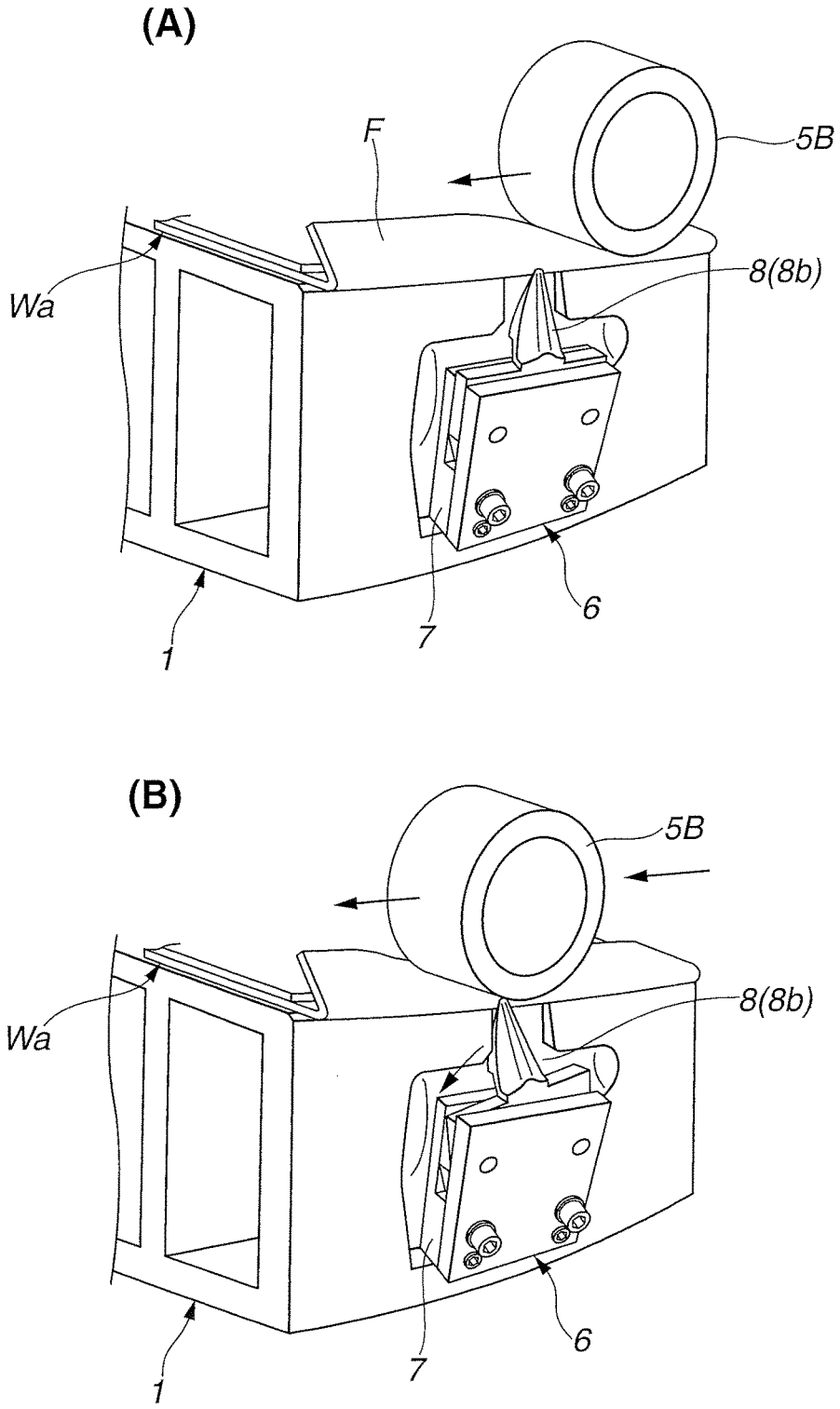
FIGS. 10(A) and 10(B) are explanatory views showing the progress of processing subsequent to FIG. 6(B).
Figure 11:
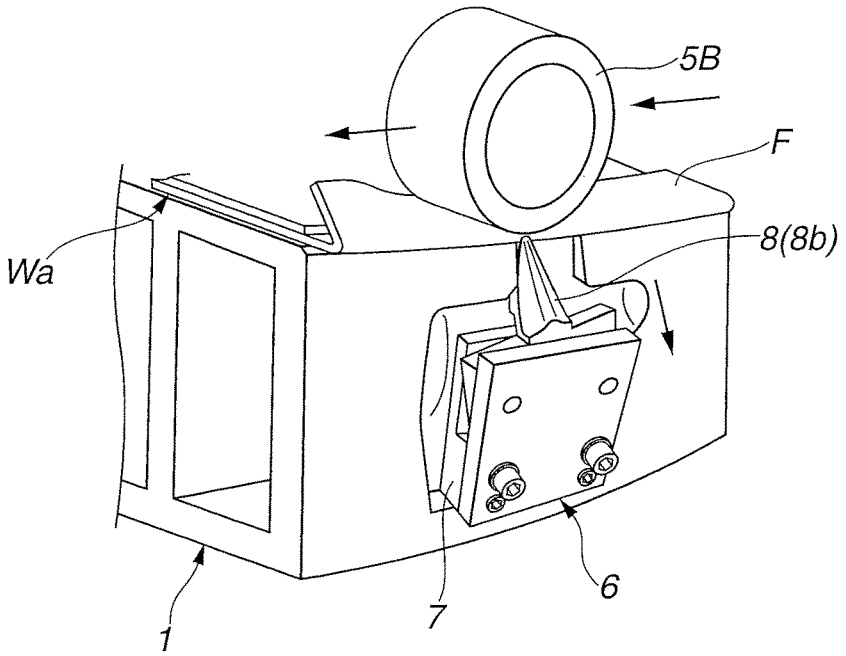
FIGS. 11(A) and 11(B) are explanatory views showing the progress of processing subsequent to FIG. 10(B).
Figure 11:
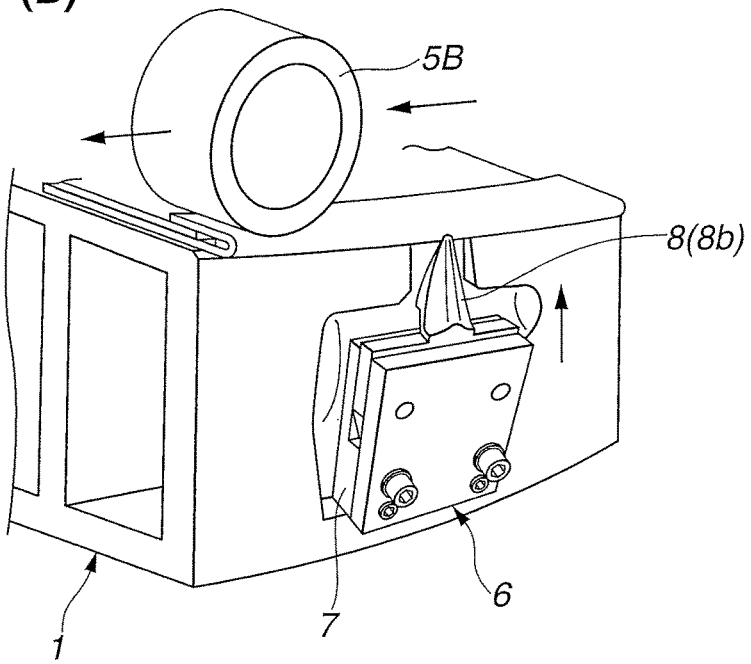

The respective diameters of the pins 13 are determined to be smaller than the width dimensions of the elongated holes 10 formed on the side of the nesting block 8, so that the relationship between the elongated holes 10 and the pins 13 is established by the so-called loose fit. With this arrangement, the nesting block 8 is provided retractable in the direction of arrow P1 of FIG. 8(A) (the vertical direction with respect to the holder 7) and swingably displaceable within a range of each of the elongated holes 10 in the direction of arrow P2 of FIG. 8(A). However, the nesting block 8 is adapted to maintain the state as shown in FIGS. 7 to 9(B) by itself since the pins 13 are brought into contact with a lower end of the elongated holes 10 as shown in FIG. 9(A) unless external forces are not applied to the nesting block 8.

As shown in FIG. 7, the hemming die 1 is previously formed with the concave part 14 in such a manner as to fall a degree, on the side wall 1*b* and at a part around which the nesting mechanism 6 is to be mounted. The holder 7 of the nesting mechanism 6 is secured onto an inner bottom surface of the concave part 14. Moreover, behind the nesting claw section 8*b* of the nesting mechanism 6, a recess part 15 wider than the nesting claw section 8*b* is formed to continue into the concave part 14. With this, at least the nesting claw section 8*b* of the nesting block 8 (a tip end of the nesting block 8) is disposed to face the recess part 15 and the nesting claw section 8*b* maintains a state of noncontact with the hemming die 1. As is clear from FIG. 7, the tapered end of the nesting claw section 8*b* is slightly upwardly projected from the die face 1*a* of the hemming die 1.

As shown in FIGS. 8(A)-8(B) and 9(A)-9(B) in addition to FIGS. 2(A)-2(B), the nesting claw section 8*b* is formed into the so-called tapered shape when viewed from the front, in such a manner that its width dimension is gradually decreased toward the upward direction (the projecting direction of the hemming flange portion F as shown in FIG. 6(A)). Also when viewed from the side, the nesting claw section 8*b* is formed into the so-called tapered shape in such a manner that its thickness dimension is gradually decreased toward the upward direction (the projecting direction of the hemming flange portion F as shown in FIG. 6(A)). Additionally, the nesting claw section 8*b* serving as the tip end of the nesting block 8 has the tapered shape as discussed above while having a generally angular shape in cross section as shown in FIG. 9(B).

Since the outer panel Wa in which the hemming flange portion F is previously formed is loaded onto the die face 1*a* of the hemming die 1 as shown in FIG. 6(A), the nesting block 8 of the nesting mechanism 6 is elastically supported in a manner retractable in the projecting direction of the hemming flange portion F (the direction of arrow P1 of FIG. 8(A)) and swingably displaceable in the longitudinal direction of the hemming flange portion F (the direction of arrow P2 of FIG. 8(A)).

As is evident from FIG. 7, an upper end part of the side wall 1*b* of the hemming die 1 forms an inclined surface at an angle θ, with which the outer surface of the nesting claw section 8*b* is previously adapted to be included in almost the same plane as the upper end part of the side wall 1*b* of the hemming die 1 having an angle θ when viewed from the side.

According to the thus arranged roller hemming processing apparatus, the outer panel Wa previously formed with the hemming flange portion F at the peripheral portion is loaded onto the hemming die 1 and supported thereon as shown in FIG. 6(A). At this occasion, since the nesting mechanism 6 is provided to the periphery of the hemming die 1 and the nesting claw section 8*b* serving as the tip end of the nesting block 8 is slightly upwardly projected from the die face 1*a* of the hemming die 1 as shown in FIG. 7 and FIG. 1(A), the hemming flange portion F is brought into contact with the nesting claw section 8*b* (serving as the tip end of the nesting block 8) at its root portion, with which the position is achieved.

The positioning of the outer panel Wa relative to the nesting block 8 is thus achieved, and therefore, if a vacuum cup or a mechanical clamping mechanism (though not shown) with which the hemming die 1 is accompanied is actuated, the outer panel Wa is pressed against the die face 1*a* of the hemming die 1 and clamped thereto while the inner panel Wb is pressed and clamped by the outer panel Wa.

Once the positioning and clamping of the outer panel Wa on the hemming die 1 is completed, the robot 2 as shown in FIG. 3 comes into operation so that the pre-hemming processing (the preliminary bending) and the hemming processing (the main bending) subsequent thereto are carried out by using the tool unit 3 as shown in FIGS. 4 and 5.

While FIG. 6(A) shows a state where the outer panel Wa is loaded on the hemming die 1 prior to the pre-hemming processing (the preliminary bending), FIG. 6(B) and the subsequent drawings show an example of carrying out the hemming processing (the main bending) subsequent to the pre-hemming processing (the preliminary bending) on the hemming flange portion F that has already undergone the pre-hemming processing (the preliminary bending) in a manner as shown in FIG. 1(B) and FIG. 2(A).

As shown in FIG. 6(B), even in the state where the pre-hemming processing (the preliminary bending) has already been conducted on the hemming flange portion F of the outer panel Wa, the hemming flange portion F is still brought into contact with the nesting claw section 8*b* of the nesting block 8 at its root portion thereby being positioned as shown in FIG. 1(B).

By rolling and moving the hemming roller 5B (provided to the tool unit 3 as shown in FIGS. 4 and 5) along the hemming flange portion F, the hemming flange portion F that has already been subjected to the pre-hemming processing (the preliminary bending) is further bent to be horizontal. Thus the hemming processing (the main bending) is gradually achieved as shown in FIG. 10(A).

As the rolling movement of the hemming roller 5B progresses, the hemming roller 5B comes to interfere with the nesting claw section 8*b* of the nesting block 8 as shown in FIG. 10(B). With this, the nesting block 8 is to be pushed, displaced and retracted by the hemming roller 5B in the direction of the rolling movement of the hemming roller 5B. Hence a continuous hemming processing by the hemming roller 5B becomes feasible without the nesting block 8 adversely affecting the hemming process quality even when the hemming roller 5B comes to interfere with the nesting block 8. As a result, the nesting block 8 can stably be operated depending on neither the moving speed of the hemming roller 5B nor the contact angle of the hemming roller 5B to the nesting block 8; therefore the outer surface of a hemming coupling portion neither causes distortion nor causes hemming coupling deficiencies.

Subsequently, the hemming roller 5B arrives right above the nesting block 8 is shown in FIG. 11(A), the nesting block 8 is pressed downward from the hemming roller 5B while maintaining its incliningly displaced posture, thereby allowing the passage of the hemming roller 5B. With this, a continuous hemming processing by the hemming roller 5B becomes feasible without the nesting block 8 adversely affecting the hemming process quality, as also discussed above. When the hemming roller 5B finishes passing above the nesting block 8 as shown in FIG. 11(B), the nesting block 8 gets back to the initial state as in the case of FIG. 6(A).

As discussed above, the nesting block 8 in this case is shaped tapered upwardly in both width dimension and thickness dimension, so that the nesting claw section 8*b* is to be brought into contact with the hemming roller 5B only at its tapered tip end. In addition, since at least the tapered tip end of the nesting claw section 8*b* is not in contact with the hemming die 1, the motion of the nesting block 8 for avoiding the interference with the hemming roller 5B (i.e., the descending or retracting action and the tilting or swinging motion of the nesting block 8, made by pushing force of the hemming roller 5B) is stably performed.

Figure 12:
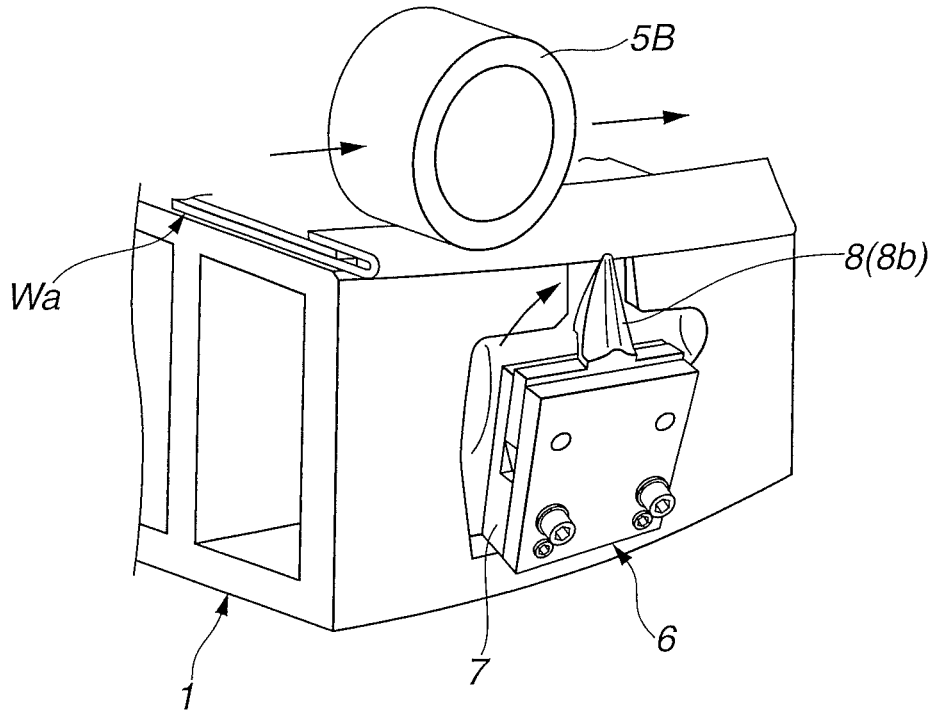
FIG. 12 is an explanatory view showing a modified example of the hemming processing as shown in FIGS. 6(A)-6(B), 10(A)-10(B), and 11(A)-11(B).

The series of motions of the nesting block 8 are not changed at all even if the movement direction of the hemming roller 5B is reversed as shown in FIG. 12, with the exception that the nesting block is inclined in the opposite direction. This means that the nesting block 8 in one or more embodiments of the present invention does not substantially select the movement direction of the hemming roller 5B.

By the way, as shown in FIG. 1(C), the hemming flange portion F is bent to have a section of a small radius of curvature at its root portion, thereby being pulled in the right direction of FIG. 1(C) to keep a slight distance from the nesting claw section 8*b* of the nesting block 8. However, there is no problem at all because the positioning function of the nesting claw section 8*b* has already become unnecessary at the time when the hemming processing has been completed.

Furthermore, the series of the motions as shown in FIG. 6(B) and FIGS. 11(A)-11(B) and 12 belong to the above-mentioned hemming processing (the main bending) as shown in FIG. 1(C) and FIG. 2(B), but those in the pre-hemming processing (the preliminary bending) conducted prior to the hemming processing (the main bending) as shown in FIG. 1(B) and FIG. 2(A) are also substantially similar thereto.

In these cases, the hemming roller 5A at the time of pre-hemming processing (the preliminary bending) is to be brought into contact with the hemming flange portion F from an oblique direction as illustrated in FIG. 1(B), so that the hemming roller 5A further tends to interfere with the nesting block 8. However, it is easy to disengage the nesting block 8 from the interference with the hemming roller 5A as in the case of the above-mentioned hemming processing (the main bending), not only because the nesting block 8 is shaped tapered upwardly in both width dimension and thickness dimension so as to be in contact with the hemming roller 5A only at its tapered tip end of the nesting claw section 8*b* as discussed above, but also because the nesting block 8*b* itself is provided with the so-called angularly-shaped cross section as shown in FIG. 9(B).

The hemming roller 5A at the time of pre-hemming processing (the preliminary bending) is to be brought into contact with the hemming flange portion F from an oblique direction as illustrated in FIG. 1(B), so that a force pressing the nesting claw section 8*b* against the hemming die 1 is to be applied to the nesting claw section 8*b* by the hemming roller 5A. However, the descending or retracting action and the tilting or swinging displaceable motion of the nesting block 8, made by the pushing force of the hemming roller 5A is stably performed because the nesting claw section 8*b* serving as the tip end of the nesting block 8 is not in contact with the hemming die 1 as mentioned above.

Though FIG. 1(B) illustrates a case where an angle β of the hemming flange portion F is about 45 degrees, it has been confirmed in the nesting block 8 according to one or more embodiments of the present that the nesting block 8 is easily disengaged from the interference with the hemming roller 5A even when an angle β of the hemming flange portion F becomes about 65 degrees.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A roller hemming processing apparatus adapted to perform a hemming processing, comprising:

a hemming die, on which a panel shaped workpiece comprising a hemming flange portion on a periphery portion thereof, is positioned and supported;

a roller hemming processing tool that is moved along a longitudinal direction of the hemming flange portion to bend the hemming flange portion at a root portion thereof while pressing the hemming flange portion toward the hemming die; and a nesting block disposed at a part of a periphery of the hemming die, wherein the nesting block performs positioning of the workpiece by being brought into contact with the root portion of the hemming flange portion with which the workpiece is formed, and wherein the nesting block is elastically supported to allow the nesting block to translate along the periphery of the hemming die to retract the nesting block in a pressing direction of the roller hemming processing tool and to allow the nesting block to be swingably displaceable in the longitudinal direction of the hemming flange portion.

2. A roller hemming processing apparatus as claimed in claim 1, wherein a supporting member that supports the nesting block is provided at the periphery of the hemming die, and wherein the nesting block is elastically supported to be retractable in the pressing direction and to be swingably displaceable in the longitudinal direction of the hemming flange portion with respect to the supporting member.

3. A roller hemming processing apparatus as claimed in claim 2, wherein the nesting block is formed to have a tapered shape where both width dimension and thickness dimension are gradually decreased in a projecting direction of the hemming flange portion.

4. A roller hemming processing apparatus as claimed in claim 3, wherein the hemming die is formed with a recess part at a part corresponding to the nesting block, thereby keeping a tip end of the nesting block from contact with the hemming die.

5. A roller hemming processing apparatus as claimed in claim 1, wherein the hemming processing tool is held by a robot arm of an industrial robot, and wherein the hemming processing tool is adapted to be moved along the longitudinal direction of the hemming flange portion by the autonomic movement of the industrial robot.

6. A roller hemming processing method, comprising:

positioning and supporting, on a hemming die, a panel shaped workpiece comprising a hemming flange portion on a periphery portion thereof;

moving a roller hemming processing tool along a longitudinal direction of the hemming flange portion to bend the hemming flange portion at a root portion thereof while pressing the hemming flange portion toward the hemming die;

disposing a nesting block at a part of a periphery of the hemming die, the nesting block performing positioning of the workpiece by being brought into contact with the root portion of the hemming flange portion with which the workpiece is formed; and combining an action of pressing the nesting block based on a pressing force of the hemming processing tool and an action of swingably displacing the nesting block in the longitudinal direction of the hemming flange portion, at a portion of the hemming flange portion corresponding to the nesting block wherein the nesting block is elastically supported to allow the nesting block to translate along the periphery of the hemming die to retract the nesting block in a pressing direction of the roller hemming processing tool and to allow the nesting block to be swingably displaceable in the longitudinal direction of the hemming flange portion.

* * * * *